United States Patent [19]

Wilkinson

[11] Patent Number: 5,056,329

[45] Date of Patent: Oct. 15, 1991

[54] HEAT PUMP SYSTEMS

[75] Inventor: William H. Wilkinson, Columbus, Ohio

[73] Assignee: Battelle Memorial Institute, Columbus, Ohio

[21] Appl. No.: 543,606

[22] Filed: Jun. 25, 1990

[51] Int. Cl.[5] ..... F25B 41/00; F25B 43/00

[52] U.S. Cl. ..... 62/197; 62/205; 62/510; 62/512

[58] Field of Search ..... 62/197, 225, 512, 205, 62/510

[56] References Cited

U.S. PATENT DOCUMENTS

| | | | |
|---|---|---|---|
| 4,517,811 | 5/1985 | Atsumi et al. | 62/197 |
| 4,624,114 | 11/1986 | Sakuma et al. | 62/512 X |
| 4,745,777 | 5/1988 | Murishita et al. | 62/510 X |
| 4,910,972 | 3/1990 | Jaster | 62/510 X |

*Primary Examiner*—William E. Wayner

*Attorney, Agent, or Firm*—Philip M. Dunson

[57] ABSTRACT

Heat pump systems (principally FIG. 3; also FIGS. 5, 7 or 9) comprising, in circuit of fluid, an injected compressor 113, communicating a compressed gas discharge 137 to a condenser 100, communicating an at least partly liquid output 130 to an expansion valve 101, communicating therefrom 131 to a separator 110, communicating liquid therefrom 134 to a capillary tube 111, and communicating gas therefrom 132 to a control valve 112 that is responsive to ambient temperature; 111 communicating the liquid therefrom 135 to an evaporator 102, communicating gas therefrom 136 to an inlet of the injected compressor 113; the control valve 112 communicating gas therefrom 133 to an injection input of the injected compressor 113; and the expansive valve 101 being adjustable 176,171 responsive to the temperature of the gas communicating 136 from the evaporator 102 to the injected compressor 113. Where the fluid comprises a non-azeotropic refrigerant blend (NARB), the system (FIG. 5; also FIG. 9) comprises also a heat exchanger 114, having a condenser section 139,140 communicating 138 the fluid from the expansion valve 101 to 131 the separator 110, and an evaporator section 141,142 communicating 136 the fluid from the evaporator 102 to 136' the inlet of the injected compressor 113.

23 Claims, 5 Drawing Sheets

HEAT PUMP SYSTEMS

FIELD

This invention relates to heat pump systems. It has to do particularly with heat pump systems for comfort conditioning in homes and other buildings, and to freezer systems capable of approaching cryogenic temperatures. Unique aspects of the invention include the novel use of a control valve, which is especially advantageous in comfort conditioning systems, and novel ways of using non-azeotropic refrigerant blend (NARB) in such systems as well as in freezing equipment, and novel uses of two-stage compressors, also especially advantageous in freezing equipment.

BACKGROUND

Another important feature of the invention is the use of injected compressors. Especially useful in heat pump systems according to the present invention is the type of injected compressor disclosed and claimed in the copending U.S. patent application of William H. Wilkinson, the present inventor, and James H. Saunders, Ser. No. 07/161,189, filed Feb. 26, 1988, for Crossed Piston Compressor with Vernier Offset Port Means, now U.S. Pat. No. 4,936,111, issued June 26, 1990. This copending patent relates to systems and apparatus for compressing gaseous fluids, especially refrigerant gas vapors operating in refrigeration cycles, combining reciprocating pistons in a rotating cylinder member that is mounted for rotation in a stationary frame and is driven by an external source of rotative power. The cylinder block rotates in an encircling port ring member which contains inlet, interstage, and outlet port sets. The number of port sets is greater or less than the number of cylinders, to provide a vernier effect in the timing of connections between the port sets and the cylinders.

The above mentioned copending patent is assigned to the assignee of the present invention. It is hereby incorporated herein by reference, and made a part hereof the same as if fully set forth herein, for purposes of indicating the background of the invention and illustrating the state of the art.

The term injected compression is used herein to mean the injection of high pressure vapor into the compression space of a compressor after the inlet suction of vapor from an evaporator is at least substantially complete. U.S. Pat. No. 4,332,144, Shaw, discusses the advantages of utilizing a scavenge vapor as a means of increasing the coefficient of performance of a refrigeration device and/or to increase the refrigeration (heat pumping) capacity of a given compressor displacement.

The copending patent cited above provides improved injection capability and also offers the option of providing two stages of compression in which the discharge of one stage of compression is fed to the second stage of compression with either or both of the stages capable of injected operation. So typical compressors according to the copending patent can be designed to have as many as four vapor inlets; the lowest pressure inlet being the output from the evaporator, the next higher pressure being the injection to the first stage of compression, the third pressure level being the interstage pressure, and the fourth being the injection to the second stage of compression.

Various advantages of such compressors are explained in the copending patent relative to refrigeration in general, but the patent does not specifically describe the advantages that an injected compressor of that type can have with NARB's as working fluids. The present invention includes additional novel system arrangements based on the general characteristics of that type of compressor. It also employs a novel type of control arrangement that provides a significant improvement over current heat pumps that extract heat from the ambient air for heating a dwelling. Improvement is shown with this system using a single refrigerant; and further improvement is shown for the slightly more complex system using a NARB as the working fluid.

The novel control arrangement for the single-stage heat pump compressor has direct application as the lower stage of a two-stage compressor system for low temperature freezer applications. One version of the system uses a single refrigerant as the working fluid; while a slightly more complex version uses NARB as the working fluid and is useful for reaching lower temperatures than the single-refrigerant system.

DRAWINGS

Figure 5:
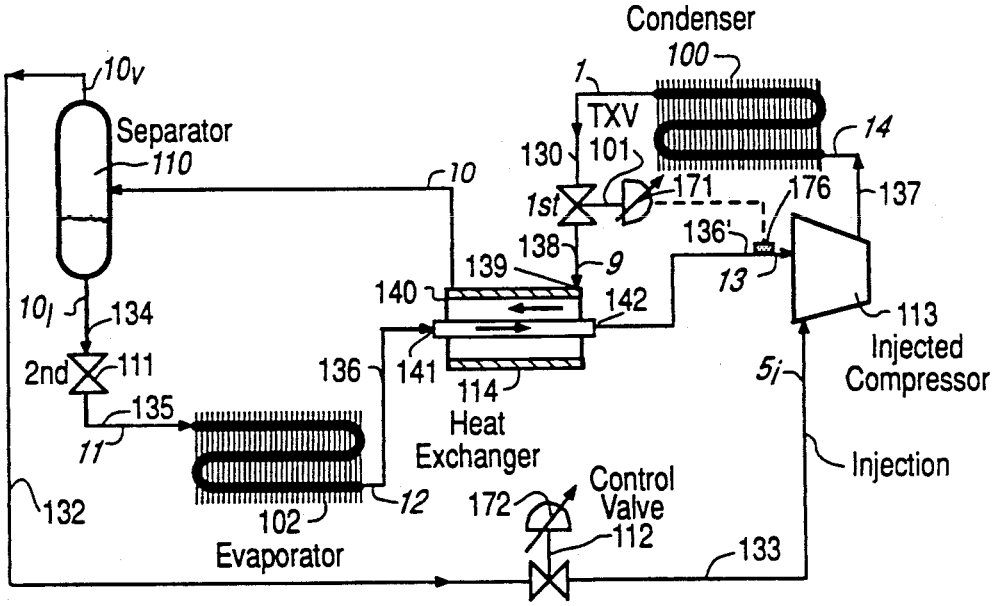
FIG. 5 is a schematic equipment diagram of another typical heat pump system according to this invention as applied to a heat pump using a NARB as the working fluid.
Figure 6:
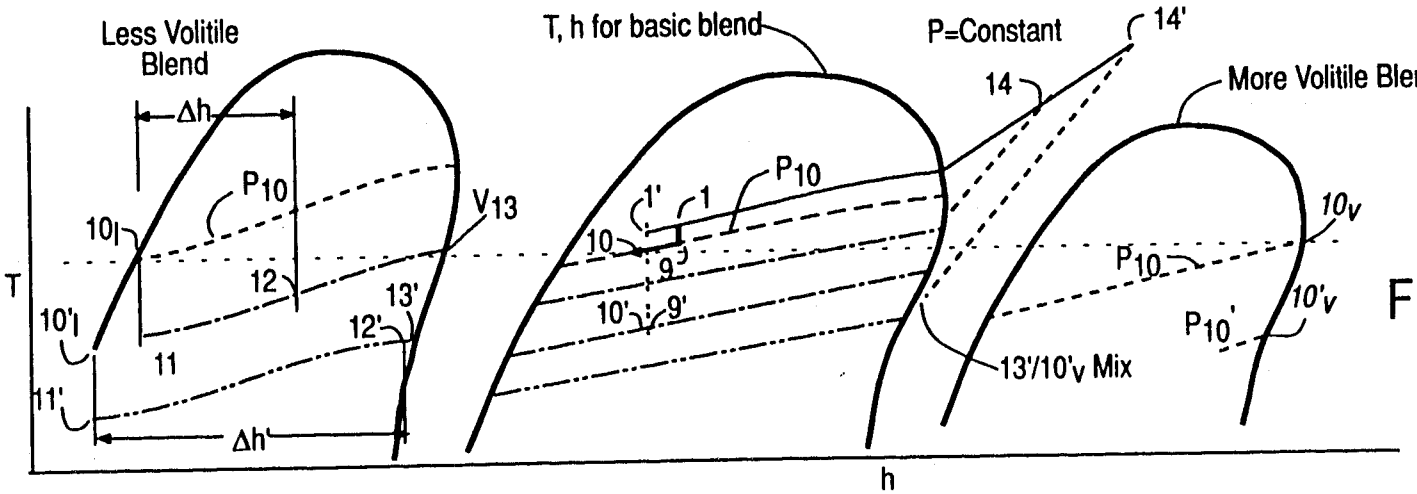

FIG. 6 is a set of Temperature-Enthalpy (T-h) plots for a system as in FIG. 5. Because the system of FIG. 5 deliberately separates the refrigerant blend that traverses the condenser into "lighter" and "heavier" blends, the companion T-h plots are shown to indicate the point in the process of the separation and to permit tracing of the processes that occur using the modified blends. Two ambient conditions are also shown to illustrate the further improved cold ambient operating capacity.

Figure 7:
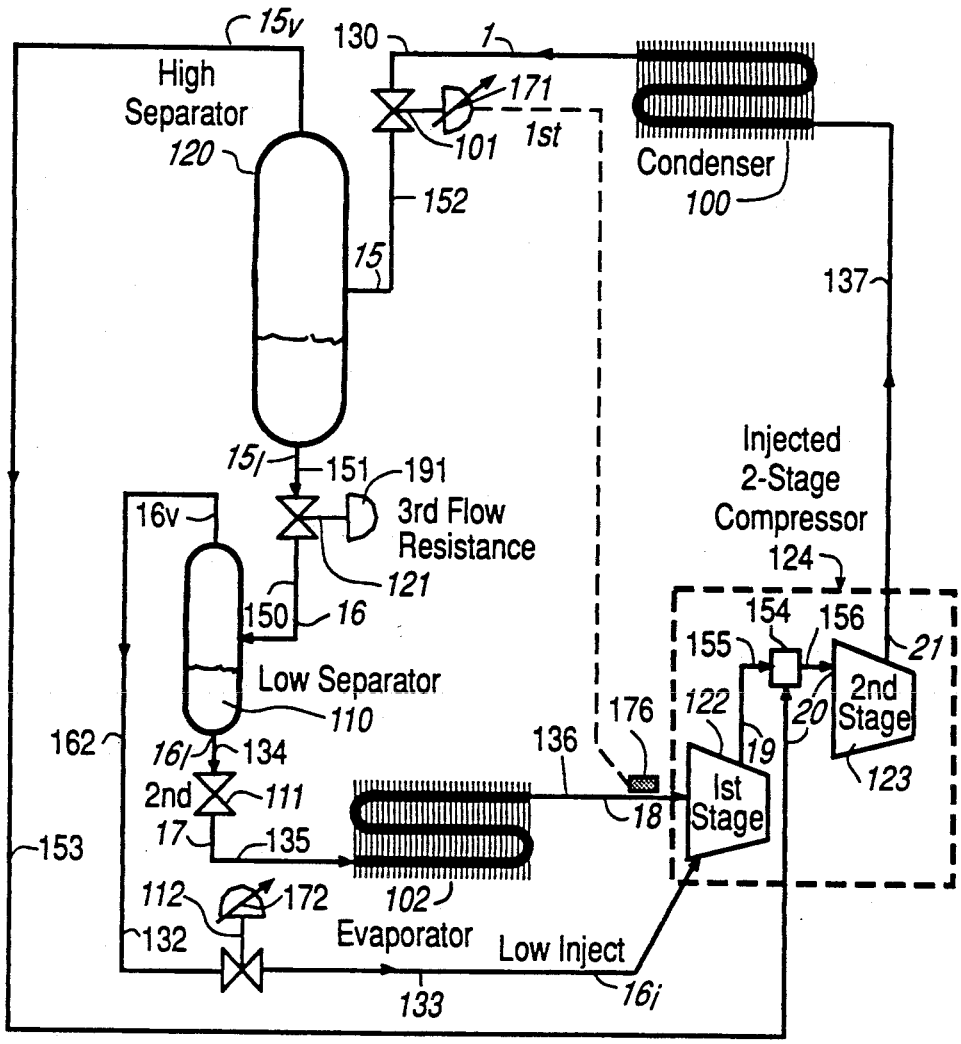

FIG. 7 is a schematic equipment diagram for a typical single refrigerant, two stage, injected compression heat pump system according to the present invention configured for low temperature freezing applications.

Figure 8:
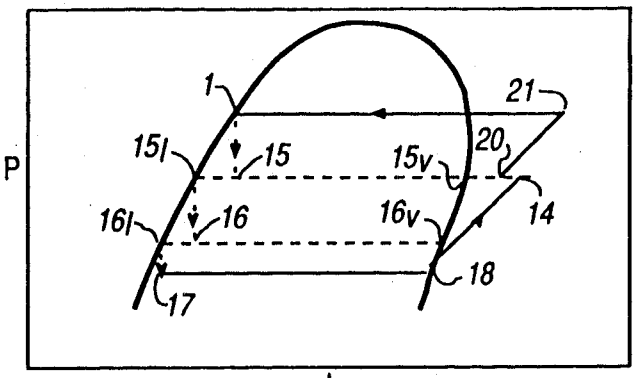

FIG. 8 is a P-h diagram for a system as in FIG. 7.

Figure 9:
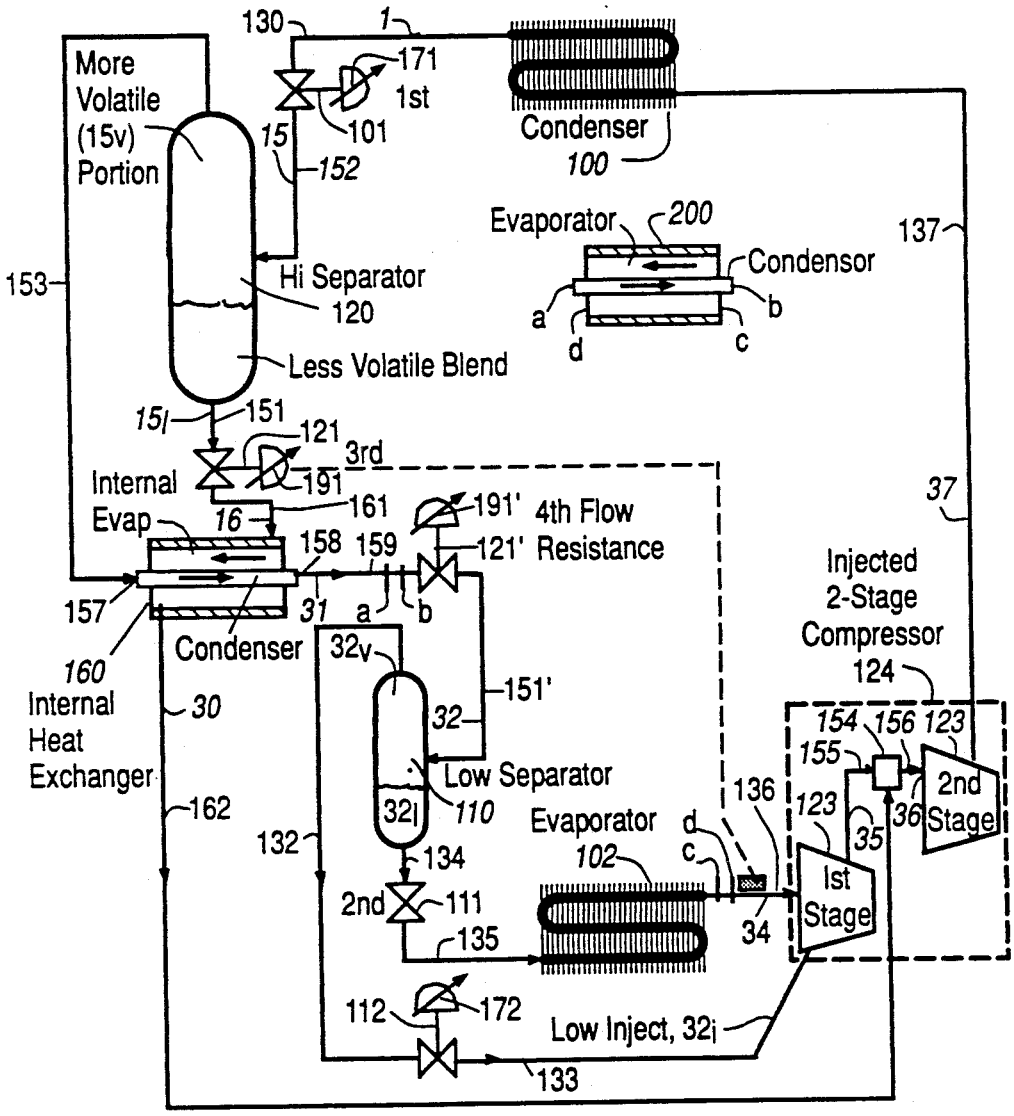

FIG. 9 is a schematic equipment diagram of another typical system according to this invention as applied to lower temperature freezing applications, using a NARB as the working fluid.

Figure 10:
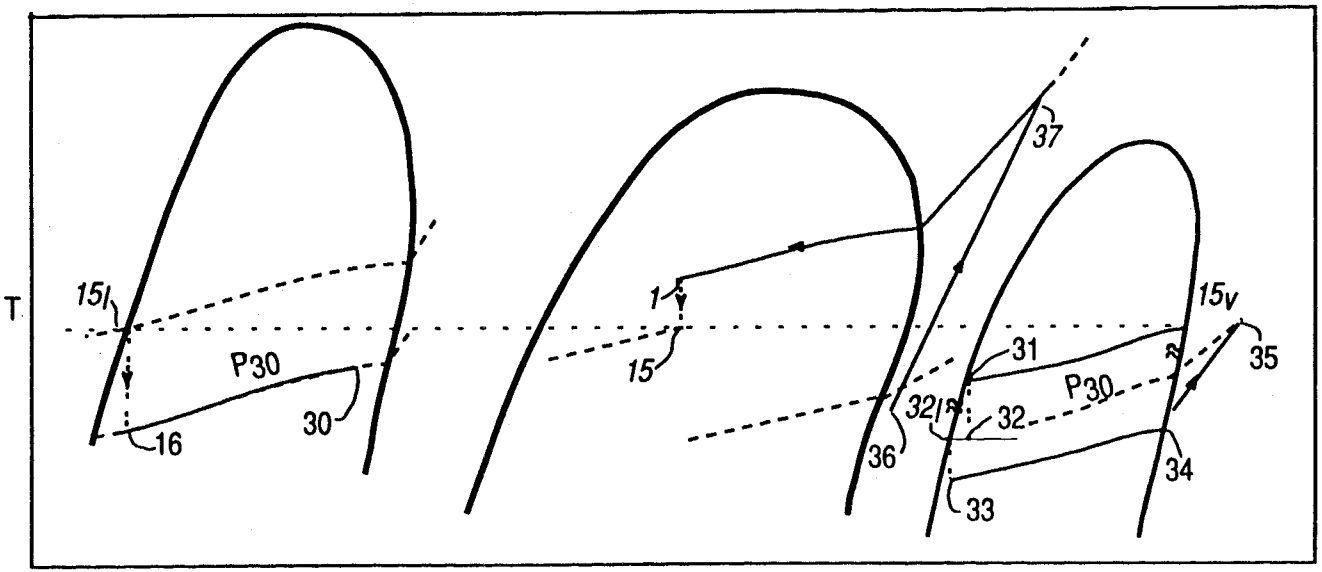

FIG. 10 is a set of T-h diagrams for a typical set of blends used in a system as in FIG. 9.

CARRYING OUT THE INVENTION

Figure 1:
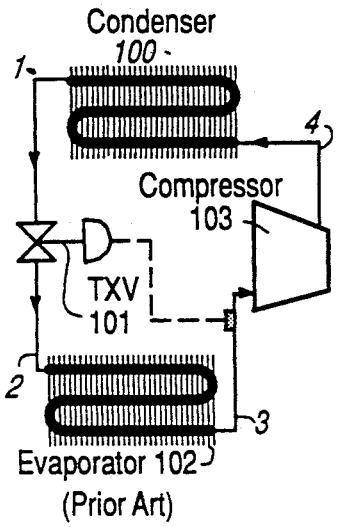
FIG. 1 is a schematic diagram of a conventional heat pump system, shown for reference purposes.

FIG. 1 illustrates the components of a conventional heat pump system to simplify the comparisons with systems according to the present invention. Liquid refrigerant, at the state point 1 on FIG. 2, leaves the condenser 100 and is expanded through the expansion valve 101 to the state point 2.

The conventional function of a thermal static expansion valve (TXV) 101 is to modulate the opening, and thus the flow resistance, of the valve 101 in response to the measured superheat of the refrigerant vapor leaving the evaporator 102. As ambient conditions change the saturation temperature at the evaporator 102, the flow resistance of the valve 101 needs to change in order to ensure that the discharge from the evaporator 102 is superheated and that the system flows are balanced. The size of the opening in the valve 101 increases (to reduce the flow resistance) with higher temperature, and decreases (to increase the flow resistance) with lower temperature.

The expanded refrigerant at 2 enters the evaporator 102 and leaves as vapor at the point 3. The vapor at 3 will vary in its amount of superheat depending on the controls employed, but, for simplicity, evaporated vapor is shown as saturated vapor in the subsequent figures. This low pressure vapor is compressed by the compressor 103 to the state point 4 where it enters the condenser 100.

Figure 2:
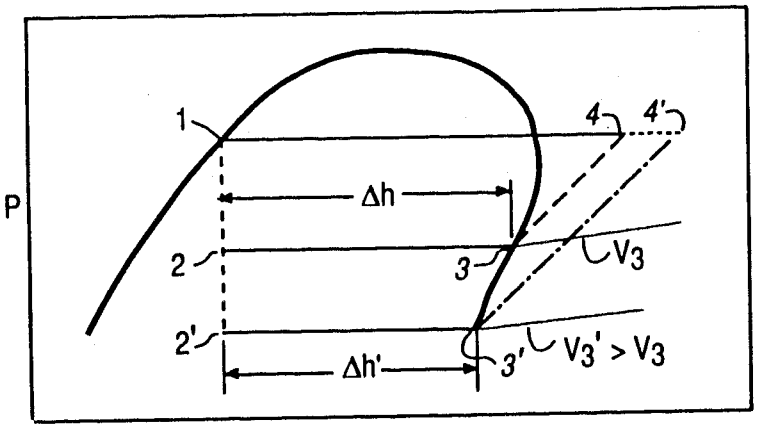
FIG. 2 is a Pressure-Enthalpy (P-h) plot for a typical refrigerant, matching state points on the plot with refrigerant conditions on the equipment diagram of FIG. 1. Two sets of state points are shown to illustrate the changes in operating conditions that occur between a warm and a cold ambient heat pumping condition.

FIG. 2 shows the refrigeration enthalpy change for the system of FIG. 1 to be $h_3-h_2$ for the warm ambient condition. The cooling capacity is proportional to the ratio of the evaporator enthalpy change to the specific volume, $V_3$, entering the compressor. When the ambient air from which the heating energy is being extracted becomes colder, the evaporator temperature must drop. With the lower evaporator temperature, as shown in FIG. 2, the enthalpy difference becomes smaller and the specific volume entering the compressor becomes larger. Both effects reduce the rated capacity of the heat pump driven by a given compressor, giving it a characteristic exactly in opposition to the heating needs of a dwelling, which needs more heat as the ambient temperature drops. Increasing the operating speed of the heat pump can overcome this problem, but it requires excessively large equipment and/or causes increased compressor wear.

Figure 3:
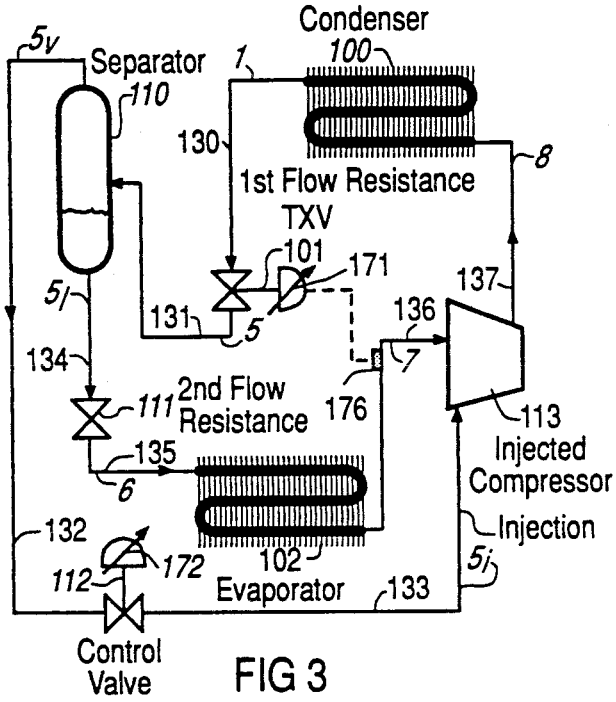
FIG. 3 is a schematic equipment diagram of a typical heat pump system according to the present invention as applied to a heat pump using a single refrigerant in a compressor, used in a single stage mode, that employs refrigerant injection after, or near, bottom dead center of the positive displacement compressor's stroke.
Figure 4:
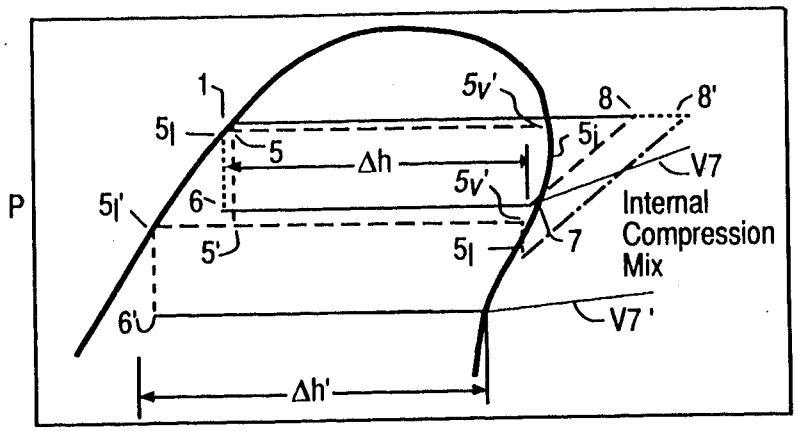
FIG. 4 is a P-h diagram for a system as in FIG. 3 showing state point numbers that correspond to refrigerant conditions achieved at the indicated points on the equipment diagram of FIG. 3. Two sets of state points are shown to illustrate the favorably modified change in heat pump operating conditions that occurs as the ambient temperatures change from warm to cold.

FIG. 3 shows a system using an injected compressor of the type disclosed and claimed in the copending patent cited above, and with a uniquely located control valve 112 which significantly reduces the capacity degradation of a heat pump as illustrated in FIG. 2. The refrigerant leaves the condenser 100 at the point 1, as in FIG. 1. In a system as in FIG. 3, the refrigerant leaving the condenser need not be fully condensed because of the liquid separation that occurs subsequently, but the fully condensed condition is easiest to follow in the cycle diagrams. The refrigerant leaving the condenser 100 is fed through the line 130 to a first flow resistance, such as the expansion valve 101, and then through the line 131 to the separator 110 where it enters as a mixture of liquid and vapor at the point 5 (FIGS. 3 and 4). The expansion valve 101 functions in a conventional manner (as in FIG. 1). Its flow resistance is adjusted, responsive to the temperature sensor 176, to maintain a suitable superheated condition at the exit of the evaporator 102.

In the separator 110 the refrigerant is separated into saturated vapor, at the point $5_v$, and saturated liquid, at the point $5_l$. The saturated liquid leaves the bottom of the separator 110 through the line 134 and enters the second flow resistance 111 which can be a fixed resistance such as a capillary tube. The low pressure refrigerant is fed through the line 135 to enter the evaporator 102 at the point 6 and leaves, as vapor, at the point 7. The vapor leaving the evaporator 102 passes through the line 136 to the inlet ports of the compressor 113.

The saturated vapor leaves the top of the separator 110 through the line 132, passes through the control valve 112 and the line 133 to enter the compressor 113 through its injection ports. The control valve 112 reduces the pressure of the vapor to the condition $5_i$ before the vapor enters the injection ports of the compressor 113. For warm ambient conditions, the control valve 112 is nearly closed, and FIG. 4 shows that a highly restricted flow position for the control valve 112 changes the evaporator load conditions very little from those shown in FIG. 2. The total flow of refrigerant entering the compressor 113 is compressed to the point 8 and is returned to the condenser 100 through the line 137.

For cold ambient conditions, however, the control valve 112 is opened so that a large flow of vapor can enter the compressor 113 through its injection ports. Since this takes place essentially after the piston is at bottom dead center, the compressor displacement only limits the flow through the line 136 from the evaporator, where the refrigerant specific volume is $V_7'$ in FIG. 4, essentially the same value as $V_3'$ in FIG. 2. The evaporation enthalpy difference, $h_7'-h_8'$, however, is much larger than in the corresponding case shown in FIG. 2. Consequently, the impact of this novel control scheme in cooperation with an injected compressor is to lessen the capacity degradation normally encountered in heat pumps.

FIG. 5 illustrates the modified schematic arrangement for a system that uses a NARB as the working fluid in a heat pump application. FIG. 5 is essentially the same as FIG. 3 except for the addition of a heat exchanger 114. The use of a NARB, however, causes significantly different detailed fluid property changes as shown in FIG. 6. For a NARB, the refrigerant blend passing through the condenser 100, at essentially constant pressure, drops in temperature as the liquid portion increases during condensation. This means that the constant pressure lines within the vapor dome (the phase-change region), are slanted, as shown in FIG. 6. The center vapor dome in FIG. 6 represents the characteristics of a given mixture of refrigerants, one significantly more volatile than the other, that exist in the condenser. At the right hand edge of the vapor dome the vapor has the same mixture proportions as the liquid at the other boundary; but the equilibrium mixtures vary in between. Near the vapor dome the volatile constituent dominates the vapor phase, leaving the liquid concentration in equilibrium dominated by the heavier, less volatile, refrigerant.

Consequently, with the condenser 100 arranged so that the refrigerant mixture passing through it is not fully condensed, the point 1 on FIG. 6, the equilibrium vapor and liquid portions are at different concentrations. The mixture of liquid and vapor leaving the condenser 100 passes through the line 130 to the expansion valve 101, which is relatively wide open at the warm ambient conditions shown in FIG. 6. The slightly expanded mixture passes through the line 138 at the condition 9 and enters the condenser section of the heat exchanger 114 at the connection 139. Further, but not complete, condensation occurs as this fluid mixture leaves through the connection 140 at the condition 10, flowing through the line 131 to the separator 110. In the separator 110, the larger flow of liquid has a higher proportion of the heavier refrigerant than does the mixture entering the condenser 100 at the point 14. This condition is shown in FIG. 6 as the point $10_l$, a point on a different vapor dome from that shown for the mixture in the condenser 100.

This liquid leaves the separator 110 through the line 134, passes through the second flow resistance 112, such as a valve or capillary, and enters the evaporator 102 through the line 135 at the condition 11. The refrigerant mixture leaving the evaporator 102 is not fully vaporized. It passes through the line 136 to the evaporator section of the heat exchanger 114, entering at the connection 141 and leaving through the connection 142 fully evaporated at the condition 13. The evaporation energy from the point 12 to the point 13 comes from the partial condensation from the point 9 to the point 10.

The vapor leaves the separator at the point $10_v$ on the equilibrium curve for a refrigerant mixture with a larger portion of the volatile refrigerant than in the mixture in the condenser 100. This vapor passes through the line 132 to control the valve 112 where its flow is restricted to leave at a lower pressure through the line 133 to enter the injection ports of the compressor 113. The system capacity is defined by the ratio of the evaporation enthalpy difference between the points 12 and 11 to the specific volume at the point 13 entering the compressor 113 through its inlet ports. The compressor 113 compresses the combined inlet and injection flows to the point 14, passing the mixture, which now has achieved the original mixture proportions, through the line 137 to the inlet of the condenser 100.

At the lower ambient condition also illustrated in FIG. 6, the vapor at the point $10_l'$ experiences a smaller temperature drop to the point 11' than the drop from $10_l$ to 11. This causes the point 13' to be much closer to the point 9' than the point 13 is to the point 9 in the warmer ambient case. Consequently, the heat exchanger 114 transfers relatively little heat, leaving almost all of the evaporation to take place from the ambient air in the evaporator 102 when the ambient air is cold. Since it is the natural characteristic of a fixed resistance such as a capillary tube to have a smaller pressure drop under the lower mass flow conditions defined by the compressor inlet density at the lower ambient temperature conditions, the flow resistance 112 typically may be a fixed, simple capillary tube and the automatic system adjustment typically may be accomplished by the expansion valve 101.

To progressively accomplish the adjustments just described the control valve 112 is made to be responsive to ambient temperature. The result is that the simple controlled adjustment of the valve 112 to reduced ambient temperatures can increase the enthalpy difference across the evaporator 102 by a greater ratio than the ratio of the volumes entering the compressor at the point 13. This creates a significantly improved heat pump capacity characteristic. In addition, as discussed in the copending patent, injected compression improves the thermodynamic efficiency of the heat pumping (refrigeration) cycle.

The open loop function of the control valve 112 causes it to interact with the flow of the liquid from the separator 110 through the flow resistance 111 to define the level of the liquid/vapor interface in the separator 110. Alternatively, the control valve 112 may be made to respond to the liquid surface level in the separator 110 through a float actuation device. Proper design of the valve action can essentially duplicate the desired system response described above, but without requiring a sensor and actuator based on outside ambient temperature. This alternative is equally applicable to the systems of FIGS. 3, 7, and 9.

To develop the use of a NARB as a working fluid in a system with a two-stage injected compression device, it is easiest to start with a single fluid system patterned after the disclosures in the copending patent. A single refrigerant system for a low temperature freezer is shown in FIG. 7. The liquid refrigerant leaving the condenser 100 at the point 1 passes through the line 130 to the valve 101 and through the line 152 to the high separator 120, entering the high separator 120 at the point 15, as shown in FIG. 8. The liquid refrigerant at the point $15_l$ passes through the line 151, the expansion valve 121, and the line 150 to enter the low separator 110. From there the liquid refrigerant is processed identically with the refrigerant leaving the condenser 100 in the single stage system of FIG. 3. For this portion of the system the equipment and reference numbers are identical with those of FIG. 3, except that the low pressure compression stage 122 replaces the compressor 113. The liquid refrigerant passing through the line 151 at the condition $15_l$ eventually leaves the low compressor stage 122 through the line 155 at the condition 19, having provided the low temperature cooling effect at the evaporator 102.

The refrigerant vapor leaves the high separator 120 at the condition $15_v$ through the line 153 to the mixing chamber 154, which also receives the output from the low pressure compressor (first stage) 122 at the condition 19 through the line 155. The mixed result at the point 20 passes through the line 156 to the inlet of the high pressure compressor (second stage) 123 of the compressor system 124, which, according to the copending patent, is a single, integrated mechanism. The compressed refrigerant leaves the second stage 123 through the line 137 to enter the condenser 100.

A large pressure drop across the valve 101 creates a large vapor flow through the line 153 so that the larger inlet displacement of the low pressure stage 122 causes very low pressure and temperature in the evaporator 102, but the liquid separation in the separator 110 maintains a large enthalpy difference across the evaporator 102. This system can significantly expand the temperature rise capabilities of any given refrigerant with a simple refrigerant compression mechanism.

FIG. 9 converts the system of FIG. 7 to one for a NARB working fluid. Although the modification in the equipment arrangement is superficially similar to the differences between FIGS. 3 and 5, the thermodynamic modifications are significantly different. In simple terms, the objective is to rearrange the mixture proportions so that the low temperature evaporation takes place with the mixture that contains a larger portion of the more volatile refrigerant and to perform the first stage of compression with that refrigerant mix. Performing the second stage of compression with the mix containing a higher portion of the less volatile refrigerant lessens the overall pressure ratio between the external condenser and the freezer's evaporator, thus improving the performance of the compressor.

The condenser 100 in FIG. 9 is arranged to condense the NARB passing through it only to quality of about 50 percent; the refrigerant mix leaving at the point 1 shown in FIG. 10. This refrigerant passes through the line 130 to the expansion valve 101, leaving through the line 152 at the condition 15 and entering the high separator 120. Because the actual freezing process is to take place with the more volatile portion, the point 15 must be near the middle of the vapor dome so that a large portion of vapor will leave the separator 120 at the condition $15_v$. This more volatile refrigerant mix enters the heat exchanger 160 through the line 153 and the connection 157 and is condensed to the condition 31, leaving through the connection 158 and the line 159 to the expansion valve 121.

The refrigerant leaves the valve 121 through the line 151 and enters the low separator 110 at the condition 32 where a small portion of a more volatile mix passes through the line 132, the control valve 112, and the line 133 to enter the injection ports of the low compressor (first stage) 122 at the condition $32_i$. Typically the control valve 112 is fully open when the lowest temperature is to be achieved and, in typical cases where a fixed low temperature is desired, the control valve 112 can be omitted. The major flow of refrigerant leaves the separator 110 as liquid at the condition $32_l$, passes through the line 134 to the valve 111 where the expansion creates the condition 33, the condition entering the evaporator 102 through the line 135. The refrigerant leaves the evaporator 102 as vapor at the condition 34 and enters the inlet ports of the low compressor stage 122 through the line 136. The capacity of the compressor 124 is defined by the inlet conditions at the point 34 since the injecting of the refrigerant takes place essentially after bottom dead center. The resulting refrigerant mix is compressed by the low compressor stage 122 and leaves at the condition 35 through the line 155 to the mixing chamber 154.

The less volatile blend leaves the high separator 120 as a liquid at the condition $15_l$ through the line 151, the expansion valve 121, and the line 161 to enter the evaporating section of the heat exchanger 160 at the condition 16. This refrigerant flow through the heat exchanger 160 causes the condensation from the point $15_v$ to the point 31 as this refrigerant flow evaporates from the point 16 to the point 30. The refrigerant at the point 30 flows through the line 162 to the mixing chamber 154 and need not be fully evaporated; thus allowing the mixing with the superheated discharge from the low compressor 122 at the condition 35 to complete the evaporation process, so that the refrigerant at the point 36 entering the second compression stage 123 is only slightly superheated. This final mixing restores the blend to its high pressure proportions, and the refrigerant leaves the compressor 124 at the condition 37 and passes through the line 137 to the condenser 100.

Additional equipment can enhance the low temperature capabilities of this system. For example, a recuperative heat exchanger 200 can be added between the refrigerant flowing in the line 159 and that in the line 136 in FIG. 9. With this addition, the heat extracted from the refrigerant "in the line 136" can be defined as completing the evaporation while the refrigerant flow "in the line 159" is subcooled. A convenient way of doing this is to disconnect the two ends of the line 159 from one another at the points a,b, and then to connect one section of the recuperative heat exchanger 200 (as indicated thereon at a,b) to the respective points a,b in the line 159; and to disconnect the two ends of the line 136 from one another at the points c,d, and then to connect the other section of the recuperative heat exchanger 200 (as indicated thereon at c,d) to the respective points c,d in the line 136.

To summarize, in the format and terminology of the claims, a typical heat pump system according to the present invention (principally FIG. 3; also FIG. 5, 7, or 9) comprises, in circuit of fluid means, A. injected compressor means 113, communicating a compressed gas discharge 137 to B. condenser means 100, communicating an at least partly liquid output 130 to C. first flow resistance means 101, communicating therefrom 131 to D. separator means 110, a. communicating liquid therefrom 134 to second flow resistance means 111, and b. communicating gas therefrom 132 to control valve means 112;

E. the second flow resistance means 111 communicating the liquid therefrom 135 to F. evaporator means 102, communicating gas therefrom 136 to inlet means of the injected compressor means 113;

the control valve means 112 communicating gas therefrom 133 to injection input means of the injected compressor means 113; and the first flow resistance means 101 being adjustable by means 176,171 responsive to the temperature of the gas communicating 136 from the evaporator means 102 to the injected compressor means 113.

Typically the control valve means 112 is adjustable 172 by means responsive to ambient temperature, the second flow resistance means 111 comprises either fixed means or means responsive to ambient temperature, and the first flow resistance means 101 comprises expansion valve means.

As in FIG. 5, where the fluid means comprises a nonazeotropic refrigerant blend (NARB), the system typically comprises also G. heat exchanger means 114, having c. a condenser means section 139,140 communicating 138 the fluid means from the first flow resistance means 101 to 131 the separator means 110, and d. an evaporator means section 141,142 communicating 136 the fluid means from the evaporator means 102 to 136' the inlet means of the injected compressor means 113.

In another typical heat pump system (FIG. 7), the injected compressor means A comprises H. injected two-stage compressor means 124 comprising e. low-pressure first stage injected compressor means 122, whose inlet means receives 136 gas from the evaporator means 102, and whose compressed gas discharge is communicated 155 to first inlet means of f. mixing chamber means 154, whose output mixture is communicated 156 to inlet means of g. high pressure second stage compressor means 123 whose further compressed discharge is communicated 137 to the condenser means 100;

and the separator means D comprises

I. high pressure separator means 120 receiving 152 the fluid means from the first flow resistance means 101, communicating liquid therefrom 151 to third flow resistance means 121, and communicating gas therefrom 153 to second inlet means of the mixing chamber means 154; and J. low pressure separator means 110 receiving liquid 150 from the third flow resistance means 121, communicating liquid therefrom 134 to the second flow resistance means 111, and communicating gas therefrom 162.132 to the control valve means 112. Typically the third flow resistance means 121 either comprises fixed means such as capillary tube means, or comprises means 191 responsive to ambient temperature at the evaporator 102.

As in FIG. 9, where the fluid means comprises a nonazeotropic refrigerant blend (NARB), the system typically comprises also K. heat exchanger means 160, having h. a condenser means section 157,158 communicating 153 a more volatile portion of the fluid means from the high pressure separator means 120 to 159 fourth flow resistance means 121', and thence 151' to inlet means of the low pressure separator means 110, and i. an evaporator means section 161,162 communicating 162 a less volatile portion of the fluid means from the third flow resistance means 121 to 162 the inlet means of the mixing chamber means 154. Typically the fourth flow resistance means 121' either comprises fixed means such as capillary tube means, or comprises means 191' responsive to ambient temperature.

Another typical heat pump system as in FIG. 9, having enhanced low temperature capabilities, comprises also L. recuperative heat exchanger means 200, having j. a condenser means section a,b communicating 159 the partially condensed vapor 159 from the internal heat exchanger means 160 to the fourth flow resistance means 121', and k. an evaporator means section c,d communicating 136 the partially evaporated fluid from the evaporator means 102 to the inlet means of the first stage compressor means 123.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit or scope of the invention.

To facilitate the understanding of the claims, reference numerals are included to identify corresponding elements in the drawings and the detailed description for the respective means recited in the claims. The use of the reference characters is to be considered as having no effect on the scope of the claims. (Manual of Patent Examining Procedure 608.01(m)). In accordance with 35 USC 112, last paragraph, the various elements in the combinations claimed are expressed as means for performing specified functions, and the claims shall be construed to cover the corresponding elements described in the specification and equivalents thereof.

I claim:

1. A heat pump system (principally FIG. 3; also FIG. 5, 7, or 9) comprising, in circuit of fluid means, A. injected compressor means 113 for providing a compressed gas discharge 137 to B. condenser means 100 for providing an at least partly liquid output 130 to C. first flow resistance means 101 for providing 131 to D. separator means 110 a. for providing liquid 134 to second flow resistance means 111, and b. for providing gas 132 to control valve means 112;

E. the second flow resistance means 111 comprising means for providing liquid 135 to F. evaporator means 102 for providing gas 136 to inlet means of the injected compressor means 113;

the control valve means 112 comprising means for providing gas 133 to injection input means of the injected compressor means 113; and the first flow resistance means 101 being adjustable by means 176,171 responsive to the temperature of the gas that is provided 136 from the evaporator means 102 to the injected compressor means 113.

2. A heat pump system as in claim 1, wherein the control valve means 112 is adjustable 172 by means responsive to ambient temperature.

3. A heat pump system as in claim 1, wherein the second flow resistance means 111 comprises fixed means.

4. A heat pump system as in claim 1, wherein the second flow resistance means 111 comprises means responsive to ambient temperature.

5. A heat pump system as in claim 1, wherein the first flow resistance means 101 comprises expansion valve means.

6. A heat pump system (FIG. 5) as in claim 1, wherein the fluid means comprises a non-azeotropic refrigerant blend (NARB), and the system comprises also G. heat exchanger means 114, having c. a condenser means section 139,140 for providing 138 the fluid means from the first flow resistance means 101 to 131 the separator means 110, and d. an evaporator means section 141,142 for providing 136 the fluid means from the evaporator means 102 to 136' the inlet means of the injected compressor means 113.

7. A heat pump system as in claim 6, wherein the control valve means 112 is adjustable 172 by means responsive to ambient temperature; and the first flow resistance means 101 comprises expansion va.ve means.

8. A heat pump system as in claim 6, wherein the control valve means 112 is adjustable 172 by means responsive to ambient temperature; and the second flow resistance means 111 comprises means responsive to ambient temperature.

9. A heat pump system as in claim 6, wherein the control valve means 112 is adjustable 172 by means responsive to ambient temperature; and the second flow resistance means 111 comprises fixed means such as capillary tube means.

10. A heat pump system (FIG. 7) as in claim 1, wherein the injected compressor means A comprises H. injected two-stage compressor means 124 comprising e. low-pressure first stage injected compressor means 122 having inlet means for receiving 136 gas from the evaporator means 102, and outlet means 19 for providing a compressed gas discharge 155 to first inlet means of f. mixing chamber means 154 for providing an output mixture 156 to inlet means of g. high pressure second stage compressor means 123 for providing a further compressed discharge 137 to the condenser means 100;

and wherein the separator means D comprises

I. high pressure separator means 120 for receiving 152 the fluid from the first flow resistance means 101, for providing liquid 151 to third flow resistance means 121, and for providing gas 153 to second inlet means of the mixing chamber means 154; and J. low pressure separator means 110 for receiving liquid 150 from the third flow resistance means 121, and for providing liquid 134 to the second flow resistance means 111, and for providing gas 162,132 to the control valve means 112.

11. A heat pump as in claim 10, wherein the control valve means 112 is adjustable 172 by means responsive to ambient temperature; the second flow resistance means 111 comprises fixed means; and the first flow resistance means 101 comprises expansion valve means.

12. A heat pump system (FIG. 9) as in claim 10, wherein the fluid means comprises a non-azeotropic refrigerant blend (NARB), and the system comprises also K. heat exchanger means 160, having h. a condenser means section 157,158 for providing 153 a more volatile portion of the fluid means from the high pressure separator means 120 to 159 fourth flow resistance means 121', and thence 151' to inlet means of the low pressure separator means 110, and i. an evaporator means section 161,162 for providing 162 a less volatile portion of the fluid means from the third flow resistance means 121 to 162 the inlet means of the mixing chamber means 154.

13. A heat pump system as in claim 12, wherein the control valve means 112 is adjustable 172 by means responsive to ambient temperature at the evaporator 102; and the first flow resistance means 101 comprises expansion valve means.

14. A heat pump system (FIG. 9) as in claim 12, having enhanced low temperature capabilities, comprising also L. recuperative heat exchanger means 200, having j. a condenser means section a,b for providing the partially condensed vapor 159 from the internal heat exchanger means 160 to the fourth flow resistance means 121', and k. an evaporator means section c,d for providing the partially evaporated fluid from the evaporator means 102 to the inlet means 136 of the first stage compressor means 123.

15. A heat pump system as in claim 12, wherein the control valve means 112 is adjustable 172 by means responsive to ambient temperature at the evaporator 102; and the first flow resistance means 101 comprises means responsive to ambient temperature at the evaporator 102.

16. A heat pump system as in claim 12, wherein the control valve means 112 is adjustable 172 by means responsive to ambient temperature at the evaporator 102; and the first flow resistance means 101 comprises fixed means such as capillary tube means.

17. A heat pump system as in claim 12, wherein the control valve means 112 is adjustable 172 by means responsive to ambient temperature at the evaporator 102; and the second flow resistance means 111 comprises fixed means.

18. A heat pump system as in claim 2, wherein the control valve means 112 is adjustable 172 by means responsive to ambient temperature at the evaporator 102; and the third flow resistance means 121 comprises means 191 responsive to ambient temperature at the evaporator 102.

19. A heat pump system as in claim 12, wherein the control valve means 112 is adjustable 172 by means responsive to ambient temperature at the evaporator 102; and the third flow resistance means 121 comprises fixed means such as capillary tube means.

20. A heat pump system as in claim 2, wherein the control valve means 112 is adjustable 172 by means responsive to ambient temperature at the evaporator 102; and the fourth flow resistance means 121' comprises means 191' responsive to ambient temperature.

21. A heat pump system as in claim 12, wherein the control valve means 112 is adjustable 172 by means responsive to ambient temperature at the evaporator 102; and the fourth flow resistance means 121' comprises fixed means such as capillary tube means.

22. A heat pump as in claim 10, wherein the control valve means 112 is adjustable 172 by means responsive to ambient temperature; the second flow resistance means 111 comprises fixed means; and the third flow resistance means 121 comprises means 191 responsive to ambient temperature at the evaporator 102.

23. A heat pump as in claim 10, wherein the control valve means 112 is adjustable 172 by means responsive to ambient temperature; the second flow resistance means 111 comprises fixed means; and the third flow resistance means 121 comprises fixed means such as capillary tube means.

* * * * *